United States Patent [19]

Pitts

[11] Patent Number: 4,770,557

[45] Date of Patent: Sep. 13, 1988

[54] EDGE MARKING OF SHEETS

[75] Inventor: Warren R. Pitts, Needham, Mass.

[73] Assignee: Dennison Manufacturing Company, Framingham, Mass.

[21] Appl. No.: 919,348

[22] Filed: Oct. 16, 1986

[51] Int. Cl.[4] ..... B43K 29/00; A46B 15/00; B05C 21/00

[52] U.S. Cl. ..... 401/193; 401/9; 401/196; 401/198; 118/264

[58] Field of Search ..... 401/198, 88, 9, 10, 401/193; 33/42, 44; 15/104.93, 104.94; 118/264

[56] References Cited

U.S. PATENT DOCUMENTS

| | | | |
|---|---|---|---|
| 807,887 | 12/1905 | Walker | 401/193 X |
| 1,323,612 | 12/1919 | Rich | 401/88 |
| 2,101,132 | 12/1937 | Daly et al. | 401/10 |
| 2,206,153 | 7/1940 | Berggruen | 401/9 |
| 2,811,732 | 11/1957 | Okamoto | 401/10 |
| 2,846,705 | 8/1958 | Marz | 401/10 |
| 3,056,998 | 10/1962 | Ebner | 401/10 |
| 3,152,352 | 10/1964 | Kosik, Jr. | 401/198 X |
| 3,887,287 | 6/1975 | Rosh, Jr. | 401/198 X |
| 4,237,641 | 12/1980 | Gupton | 401/9 X |

*Primary Examiner*—Richard J. Apley
*Assistant Examiner*—David J. Bender
*Attorney, Agent, or Firm*—George E. Kersey

[57] ABSTRACT

Marking of edges and sides adjacent edges by a fibrous, porous member having a transverse slit. A barrel houses one or more fibrous, porous members which serve as reservoirs for a marking fluid. Openings in the barrel permit the passage of a sheet between the slits.

6 Claims, 1 Drawing Sheet

EDGE MARKING OF SHEETS

BACKGROUND OF THE INVENTION

This invention relates to writing apparatus, and more particularly to markers used to mark edges.

A popular marker is of the type sold under the name MARKS-A-LOT, a product of Dennison Carter's Company. This marker includes a body which tapers at one end to hold a nib of fibrous, porous material.

The markers work well on flat surfaces, however it is desired to have a marking apparatus which is able to mark edges with ease. Great dexterity or additional equipment is necessary in order to neatly and quickly mark a side adjacent an edge. Moreover, the marking of opposing adjacent sides of an edge simultaneously is not possible with the prior art markers. Accordingly, it is an object of the present invention to provide a marker which functions well for writing, while enabling the quick and easy marking of edges and sides adjacent edges.

It is a further object of the invention to provide a marker which can mark edges and sides adjacent edges quickly in several different colors, or with several different materials.

SUMMARY OF THE INVENTION

In accomplishing the foregoing and related objects, the invention provides for the marking of sheets, whereby the edges and sides adjacent to the edges are marked, such as by an ink.

A fibrous, porous member is provided with a slit and is housed in a barrel which has an opening disposed from the passage of a sheet between the slit.

In accordance with one embodiment of the invention a plurality of fibrous, porous members each having a slit are housed by one barrel. Alternatively, each fibrous, porous member may have several slits, with the barrel having corresponding openings to permit entry of a sheet between the slit.

In a preferred embodiment of the invention, each of the porous, fibrous members are of a different color. In this manner the marker may be used to mark items of a different subject matter. In a preferred embodiment the slits are formed transverse to the longitudinal axis of the marker. In this manner the marker is easily held in one hand while the sheet is drawn through the slit by the other hand; or alternatively the sheet is held stationary while the marker is slid down its edge.

In accordance with another embodiment of the invention a nib is formed as an extension of the fibrous, porous member and extends from at least one end of the barrel. The nib may additionally be provided with a slit for edge marking in a similar manner as to the slits disposed within the barrel. In a preferred embodiment the slit and openings are disposed proximate this nib, whereby a cap may be used to cover not only the nib but also the slit.

DESCRIPTION OF THE DRAWINGS

Other aspects of the invention will become apparent after considering several illustrious embodiments taken in conjunction with the drawings in which:

With reference to FIGS. 1 and 2, a marker has an opening in a barrel, and a slit in a fibrous, porous reservoir, whereby a sheet is passed through the opening and between the slit, thereby simultaneously marking an edge and its two adjacent sides.

As shown in FIG. 1, marker 100 includes a barrel 102 which houses a fibrous, porous reservoir 104. Reservoir 104 is provided with a slit 106 exposed by opening 108 in barrel 102. In the embodiment shown, opening 108 and slit 106 are disposed proximate nib 110. As a result, a cap 112 covers opening 108 as well as nib 110.

In operation, a sheet, such as paper, is inserted within opening 108, and slid within slit 106. The opposing side walls of slit 106 are in mutual contact, whereby these side walls press against both sides of the sheet when inserted. As the sheet is inserted fully into 106, the sheet edge will be marked. Drawing the sheet in either direction produces continuous lengthwise markings.

Figure 1:
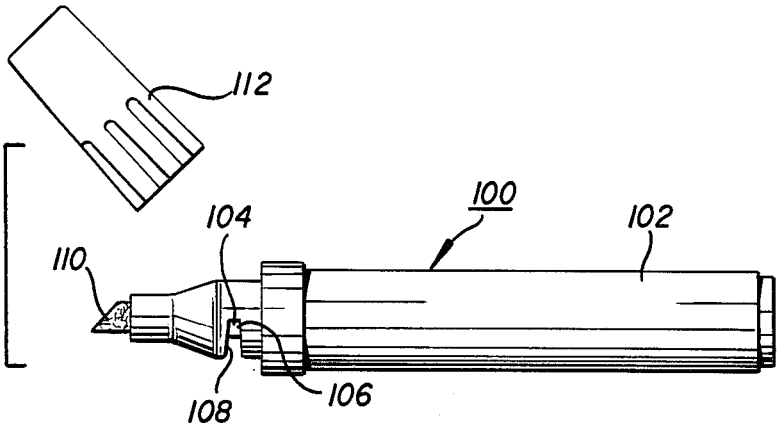
FIG. 1 is a side view of a marker instrument in accordance with the invention, with its cap removed to expose a marking tip.
Figure 2:
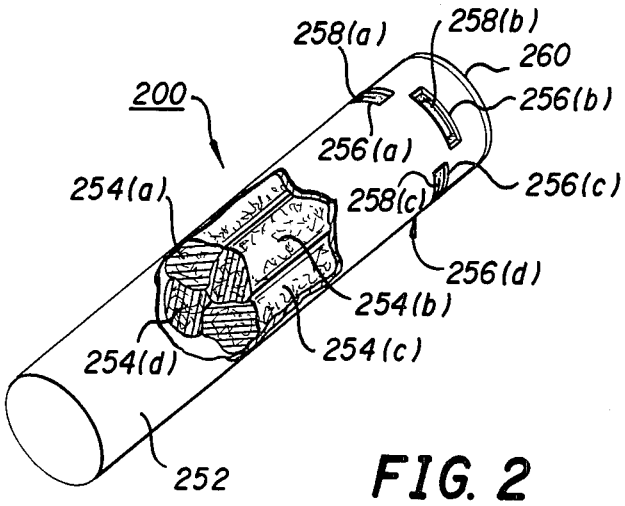
FIG. 2 is a partial perspective view of an alternative marker with a portion of the barrel broken away to reveal the use a the plurality of separate, interior porous members for providing a plurality of different marking inks.

An alternative embodiment of the invention can be seen in FIG. 2. Marker 200 includes a barrel 252 which houses four fibrous, porous members 254(*a–d*). Openings 256(*a–d*) are disposed to expose slits 258(*a–d*), which are disposed proximate the end of barrel 252. In a preferred embodiment, fibrous, porous members 254(*a–d*) are of different colors. While four fibrous, porous members are shown, it should be understood that any number of such members may be used. Openings 256(*a–d*) and slits 256(*a–d*) may be disposed at different positions relative to the end of barrel 252. This facilitates the insertion of a sheet within the desired opening. To easily distinguish between different colors or types of marking material exposed by each of the openings 256(*a–d*), the outer covering of the barrel 252 may be appropriately marked, as by color coding. Marker 200 is shown as a sealed container with a closure 260 disposed at the end closest to openings 256(*a–d*). In this embodiment there may additionally be a nib such as is shown in FIG. 1. Moreover, a cap such as 112 may be appropriately shaped to cover openings 256(*a–d*).

As can be seen in FIG. 1, nib 110 is provided with a slit extending transverse to the axis of the marker barrel 102. A sheet may be drawn through this slit to mark in a similar manner as slit 106, or 258(*a–d*).

The markers, in accordance with the invention, are advantageously used to mark sheets such as index cards or other report materials. Materials marked in this manner are easily identified by subject matter, for example. Marker 200 eliminates problems with having to repeatedly put-down and pick-up different color markers when one edge is marking in different colors. Marker 100 provides the advantage of edge-marking in accordance with the invention, while additionally enabling writing and coloring as in conventional markers. Blending of ink in marker 200 is prevented by wrapping the fibrous, porous members 254(*a–d*) in a leak proof casing, such as plastic.

Each of the fibrous, porous members, such as is shown as 106 in FIG. 1 or 254(*a–d*) in FIG. 2 may contain a marking liquid, such as an ink or dye. Examples of such marking liquids include highlighter ink or conventional marking ink. The barrel is typically fabricated from polypropylene, and may be formulated with an anti-static material, such as a fatty acid ester.

In a method of fabricating a marker instrumentality in accordance with the invention, a barrel is provided and openings are formed in the barrel. One or more fibrous porous members which may contain inks or dyes of different colors are provided for the barrel. Where the barrel contains a number of different openings, a single fibrous porous member may be used with a different slit for each opening. Alternatively a plurality of fibrous porous members may be used with a different member for each opening. Where multiple porous members are employed they may be separated from one another by a plastic film to keep ink from bleeding through to different adjoining porous members. No marker tip is needed because the openings in the barrel and the accompanying slits on porous members may be used to provide for the marking of edges of documents.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for marking sheets comprising a fibrous, porous member having a slit therein; and a barrel housing said fibrous, porous member having an opening disposed to permit passage of a sheet between said slit;

said barrel having at least two fibrous porous members, each member containing a marking fluid of a different color;

whereby an edge and a portion of the front and back of a sheet are simultaneously marked as the sheet is drawn through the slit.

2. Apparatus of claim 1, wherein a plurality of fibrous, porous members having at least one slit in each are housed by said barrel.

3. Apparatus of claim 1 wherein said barrel and said fibrous porous member have a longitudinal axis and said opening is disposed transversally to said longitudinal axis.

4. Method of fabricating a marker comprising the steps of:

1. slitting a fiberous, porous member containing a marking liquid therein;
2. forming an opening in a barrel intermediate the ends of the barrel; and
3. housing the fiberous porous member within the barrel to expose the slit through the opening.

5. Method of claim 4, wherein in step (1), a plurality of slits are made in the fibrous, porous member.

6. Method of claim 4, wherein in step (2), a plurality of openings are made in a barrel; and in step (3), a plurality of fibrous, porous members are housed within a barrel; whereby one slit is exposed through each opening.

* * * * *